US008333278B2

(12) United States Patent
Smith

(10) Patent No.: US 8,333,278 B2
(45) Date of Patent: Dec. 18, 2012

(54) COLLAPSIBLE STORAGE CONTAINER FOR FABRICS AND METHODS OF USING SAME

(75) Inventor: Tracy A. Smith, Fort Mill, SC (US)

(73) Assignee: Springs Global US, Inc., Fort Mill, SC (US)

( * ) Notice: Subject to any disclaimer, the term of this patent is extended or adjusted under 35 U.S.C. 154(b) by 233 days.

(21) Appl. No.: 12/556,095

(22) Filed: Sep. 9, 2009

(65) Prior Publication Data

US 2010/0059531 A1 Mar. 11, 2010

Related U.S. Application Data

(60) Provisional application No. 61/095,419, filed on Sep. 9, 2008.

(51) Int. Cl.
*B65D 30/08* (2006.01)

(52) U.S. Cl. ..... 206/495; 383/110; 383/109

(58) Field of Classification Search ..... 206/494, 206/495, 388; 383/33, 104, 120, 107, 109, 383/110

See application file for complete search history.

(56) References Cited

U.S. PATENT DOCUMENTS 2,532,778 A * 12/1950 Louis ..... 383/40
3,682,372 A * 8/1972 Rodley ..... 383/104
3,945,415 A * 3/1976 Febuary ..... 206/282
3,990,495 A * 11/1976 LaBarba ..... 383/110
4,091,852 A * 5/1978 Jordan et al. ..... 383/3
4,512,464 A * 4/1985 Sylvester ..... 206/292
4,900,163 A * 2/1990 Mack ..... 383/119
5,152,612 A * 10/1992 Shoemaker ..... 383/6
5,158,371 A * 10/1992 Moravek ..... 383/104
5,354,131 A * 10/1994 Mogil ..... 383/24
5,401,102 A * 3/1995 Faltynek et al. ..... 383/104
5,964,533 A * 10/1999 Ziglar ..... 383/36
6,102,569 A * 8/2000 Wang ..... 383/104
6,457,635 B1 * 10/2002 Scicluna ..... 229/87.17
6,920,993 B2 * 7/2005 Sheng-Bin ..... 220/6
7,534,041 B2 * 5/2009 Godshaw et al. ..... 383/121
2002/0148742 A1 * 10/2002 Bisbal et al. ..... 206/223
2003/0136702 A1 * 7/2003 Redzisz et al. ..... 206/545
2005/0045499 A1 * 3/2005 Bisbal et al. ..... 206/223
2006/0233465 A1 * 10/2006 Moore ..... 383/6
2007/0065049 A1 * 3/2007 Alldredge-Howard et al. .. 383/8
2008/0283350 A1 * 11/2008 Vorderkunz ..... 190/115

* cited by examiner

*Primary Examiner* — David Fidei
(74) *Attorney, Agent, or Firm* — Myers Bigel Sibley & Sajovec, P.A.

(57) ABSTRACT

A collapsible storage apparatus for fabrics includes a container movable between a collapsed position and a use position, and a fabric receiving member dimensioned to receive fabric wrapped therearound such that the fabric receiving member and fabric wrapped therearound can be removably stored within the container when the container is in the use position. The container is formed from two opposed side walls, two opposed end walls, and a flexible bottom section attached to bottom edge portions of the side and end walls. The two side walls are configured to fold such that the container has a flat configuration with the folded side walls sandwiched between the end walls when in the collapsed position.

12 Claims, 9 Drawing Sheets

COLLAPSIBLE STORAGE CONTAINER FOR FABRICS AND METHODS OF USING SAME

RELATED APPLICATION

This application claims the benefit of and priority to U.S. Provisional Patent Application No. 61/095,419, filed Sep. 9, 2008, the disclosure of which is incorporated herein by reference as if set forth in its entirety.

FIELD OF THE INVENTION

The present invention relates generally to the field of bedding products and, more specifically, to methods and apparatus for storing bedding products.

BACKGROUND OF THE INVENTION

Fitted sheets, sometimes referred to as bottom sheets, are the sheets that cover a mattress on a bed. Fitted sheets often have elastic sewn into each one of the four corners to help the sheet remain in place over the mattress. Because of their configuration, and particularly because of the elastic located in the corners, fitted sheets can be difficult to fold, for example, after cleaning.

SUMMARY

According to some embodiments of the present invention, a lightweight, collapsible storage apparatus for fabrics, such as bed sheets, includes a container movable between a collapsed position and a use position, and a fabric receiving member dimensioned to receive fabric wrapped therearound such that the fabric receiving member and fabric wrapped therearound can be removably stored within the container when the container is in the use position. In some embodiments, the container is formed from two opposed side walls, two opposed end walls, and a flexible (e.g., fabric) bottom section attached to bottom edge portions of the side and end walls. The two side walls are configured to fold such that the container has a flat configuration with the folded side walls sandwiched between the end walls when in the collapsed position. In some embodiments, the container has a substantially rectangular configuration with substantially rectangular side walls and end walls, and the fabric receiving member is substantially rectangular. In some embodiments, an outer and/or inner face of each of the walls is covered with fabric.

In some embodiments, the container includes one or more handles, each secured to a respective one of the walls. An outer face of a wall may be covered with fabric, and a respective handle may be formed by a strip of material attached to the fabric. The strip of material may be the same material as the fabric or may be a different material.

The fabric receiving member is dimensioned such that a peripheral gap exists between the fabric receiving member and the inside of the container when the fabric receiving member is stored within the container without fabric wrapped therearound. This gap is dimensioned to allow the fabric receiving member to be stored within the container with fabric wrapped around the fabric receiving member. An exemplary gap may be between about 0.25" and about 1.25".

The fabric receiving member is sufficiently rigid to permit fabrics to be wrapped therearound. In some embodiments, the fabric receiving member may be substantially rigid; in other embodiments, the fabric receiving member may be somewhat flexible.

In some embodiments, the fabric receiving member has a tube configuration (e.g., a rectangular cross-section), wherein the tube has an axial length that is less than a height of the rectangular container. In other embodiments, the fabric receiving member has an H-type frame including a pair of vertically disposed longitudinally spaced end members interconnected in upstanding relationship by a transverse member.

In some embodiments, the fabric receiving member includes written instructions for folding fabrics and storing folded fabrics in the container.

According to some embodiments of the present invention, a method of storing fabrics includes wrapping a fabric around a fabric receiving member, and storing the fabric receiving member with fabric wrapped therearound within a collapsible storage container. The container is movable between a collapsed position and a use position, and is formed from two opposed side walls, two opposed end walls, and a flexible bottom section attached to bottom edge portions of the side and end walls. The two side walls are configured to fold such that the container has a flat configuration with the folded side walls sandwiched between the end walls when in the collapsed position.

According to some embodiments of the present invention, a method of storing fabrics includes folding a fabric using a template, removing the template from the folded bedding fabric, placing the template within a collapsible storage container, and storing the folded fabric within the container on top of the template.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying drawings, which form a part of the specification, illustrate embodiments of the present invention. The drawings and description together serve to fully explain the invention.

DETAILED DESCRIPTION

Figure 1:
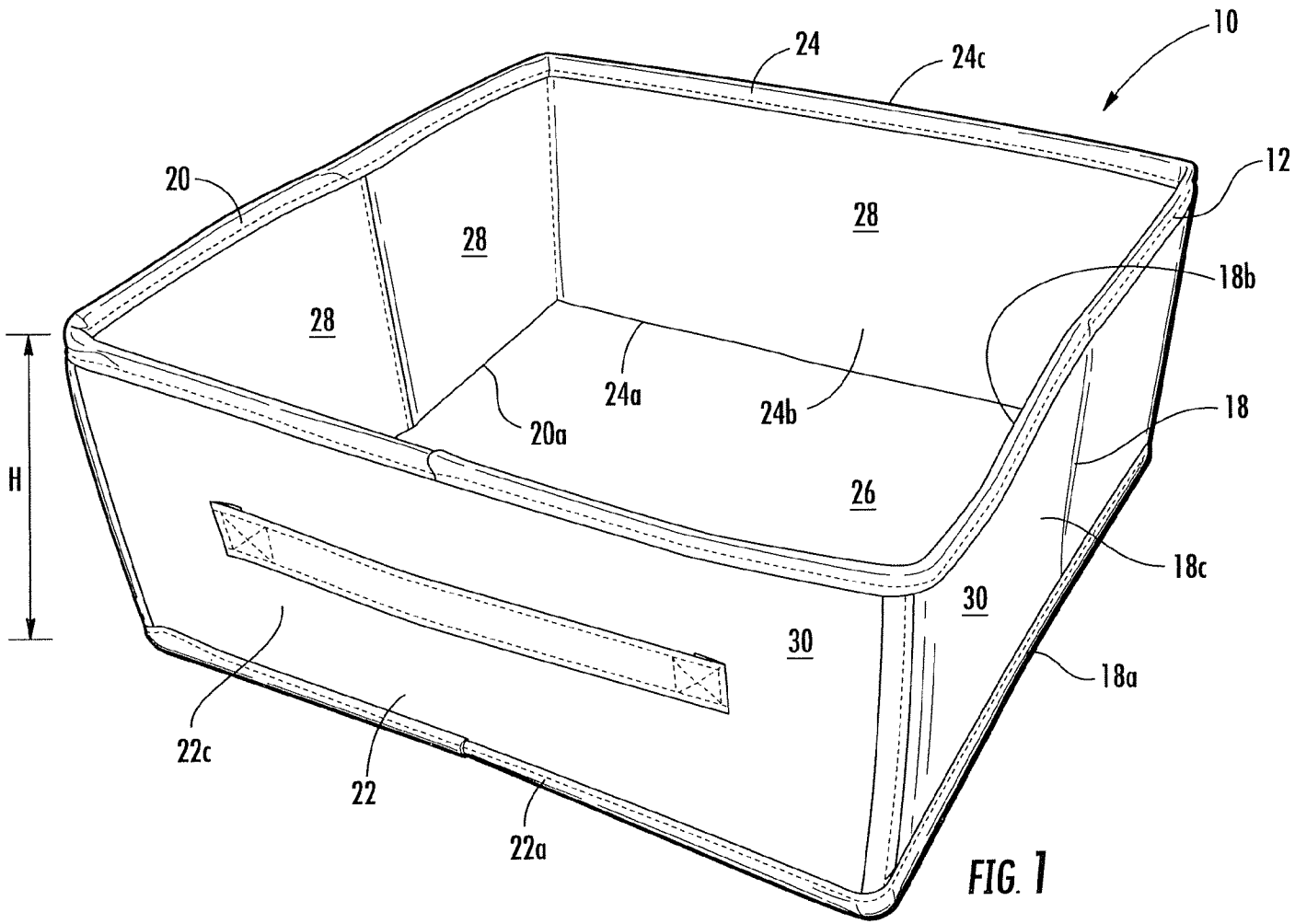
FIG. 1 is a perspective view of a collapsible storage container, according to some embodiments of the present invention.
Figure 2:
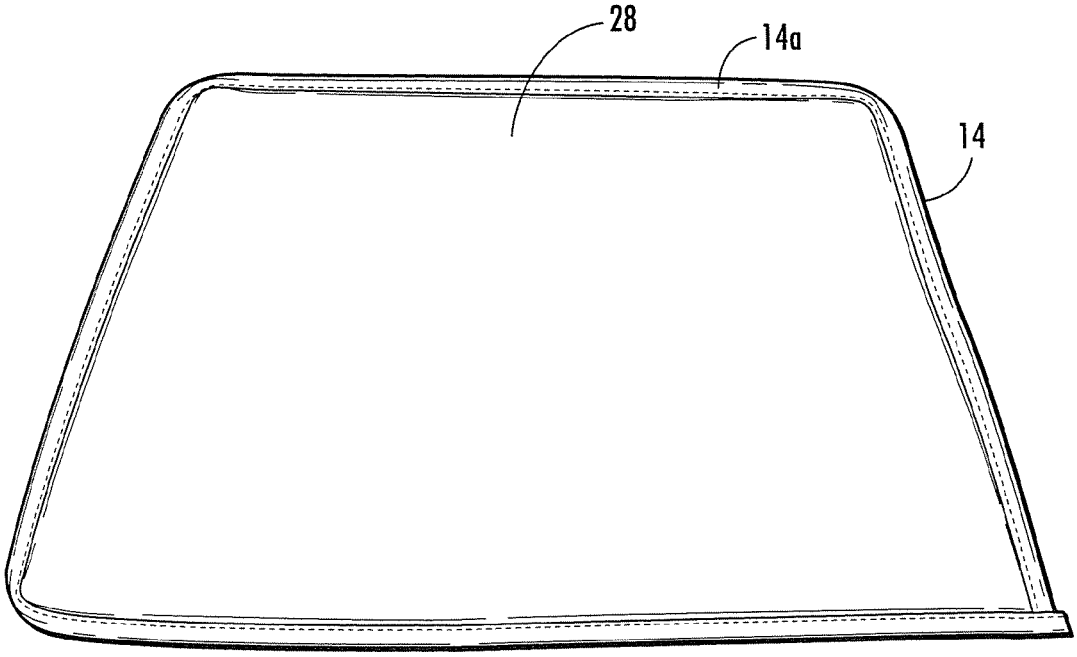
FIG. 2 is a perspective view of a fabric receiving member for use with the container of FIG. 1, according to some embodiments of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It should be further understood that the terms "comprises" and/or "comprising" when used in this specification are taken to specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "bedding fabrics" as used herein is intended to include sheets, blankets and all other bed coverings that can be folded for storage.

In the drawings, the thickness of lines, layers and regions may be exaggerated for clarity. It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under." A device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, walls and/or sections, these elements, components, walls and/or sections should not be limited by these terms. These terms are only used to distinguish one element, component, wall or section from another element, component, wall or section. Thus, a "first" element, component, wall or section discussed below could also be termed a "second" element, component, wall or section without departing from the teachings of the present invention.

Figure 6:
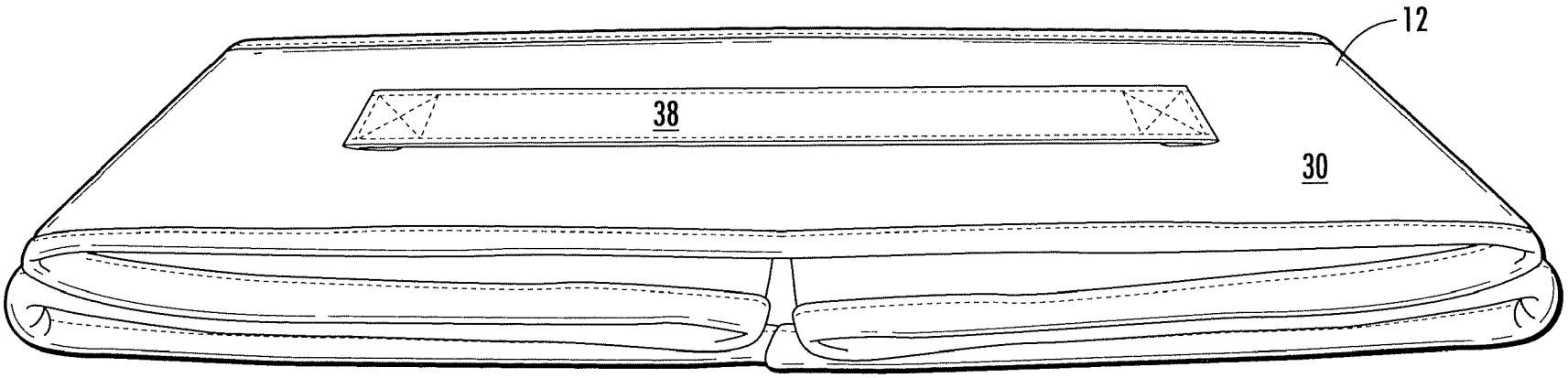
FIG. 6 is a perspective view of the collapsible storage container of FIG. 5.
Figure 7:
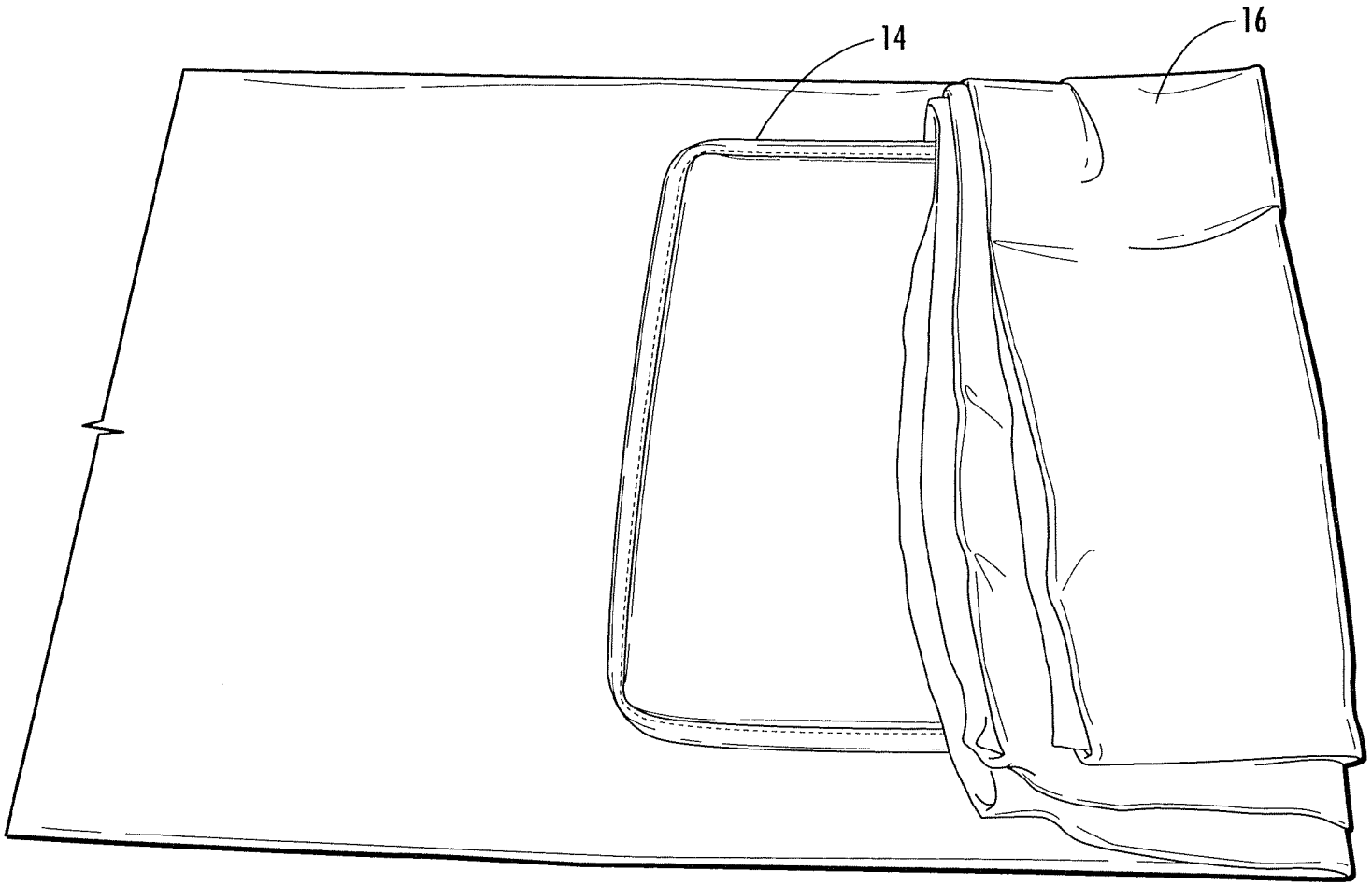
FIG. 7 illustrates a fabric being wrapped around the fabric receiving member of FIG. 2.
Figure 8:
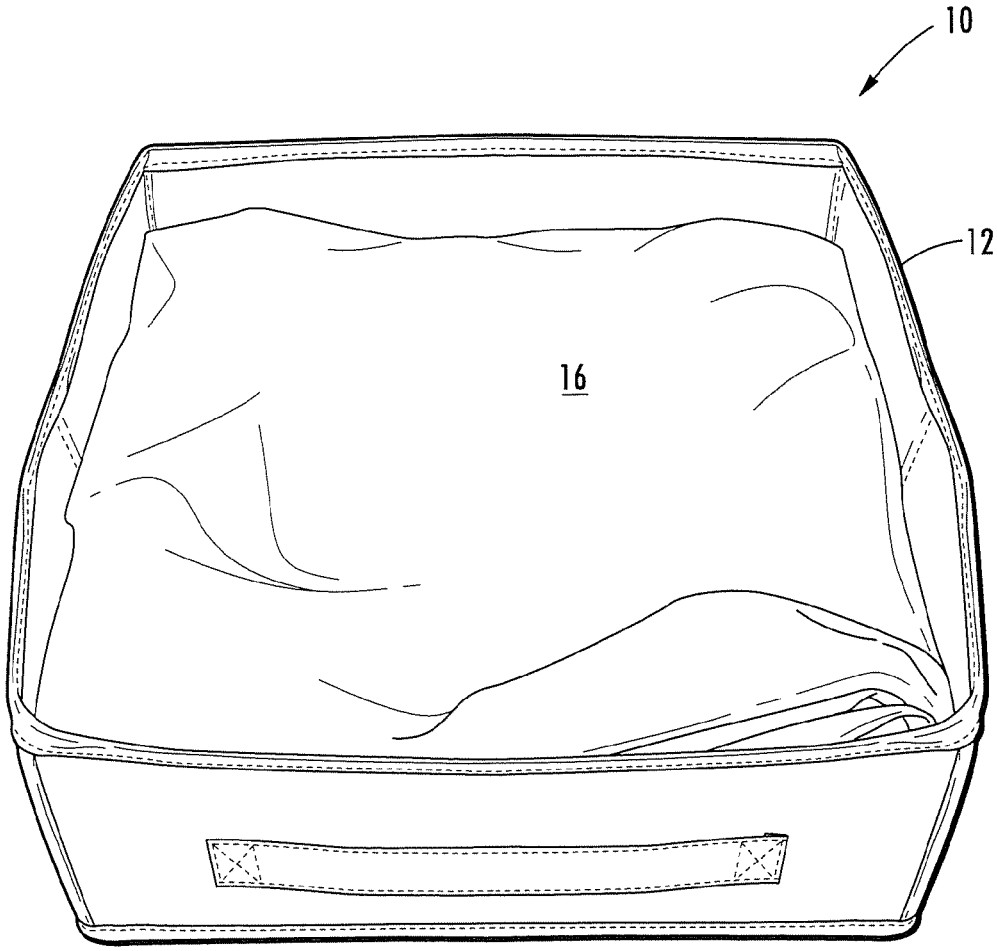
FIG. 8 illustrates the storage of fabric products within the storage container of FIG. 1.

Referring now to FIGS. 1-8, collapsible storage containers for fabrics, particularly bedding fabrics such as sheets, will now be described. The illustrated storage apparatus 10 includes a rectangular-shaped container 12, that is movable between a collapsed position (FIGS. 5-6) and a use position (FIGS. 1, 3, 8), and a fabric receiving member 14. The fabric receiving member 14 is dimensioned to receive a fabric (e.g., bed sheet 16, FIG. 7) wrapped therearound such that the fabric receiving member 14 and fabric wrapped therearound are removably insertable (i.e., can be stored) within the container 12 when the container is in the use position (FIG. 8). In some embodiments, the fabric receiving member 14 is used to facilitate folding fabrics (e.g., bedding fabrics such as sheets) and then is removed, placed in the container 12, and the folded fabrics are placed on top thereof. In other words, the fabric receiving member 14 can serve the function of a folding template, as well as a support for folded fabrics within the container 12.

The fabric receiving member 14 has sufficient rigidity to permit fabrics to be wrapped therearound. In some embodiments, the fabric receiving member 14 may be substantially rigid; in other embodiments, the fabric receiving member 14 may be somewhat flexible. As described further below, the fabric receiving member 14 can have various shapes and configurations.

The illustrated container 12 is formed from two opposed rectangular side walls 18, 20, two opposed rectangular end walls 22, 24, and a flexible bottom section 26. The flexible bottom section 26 is attached to bottom edge portions 18*a*, 20*a*, 22*a*, 24*a* of the side and end walls 18, 20, 22, 24. In the illustrated embodiment, the two side walls 18, 20 are configured to fold such that the container 12 has a flat configuration with the folded side walls 18, 20 sandwiched between the end walls 22, 24 when in the collapsed position (FIG. 6). The container side walls 18, 20 and end walls 22, 24, and the fabric receiving member 14, may be formed from various materials including, but not limited to, polymeric material, paperboard, and cardboard.

Figure 3:
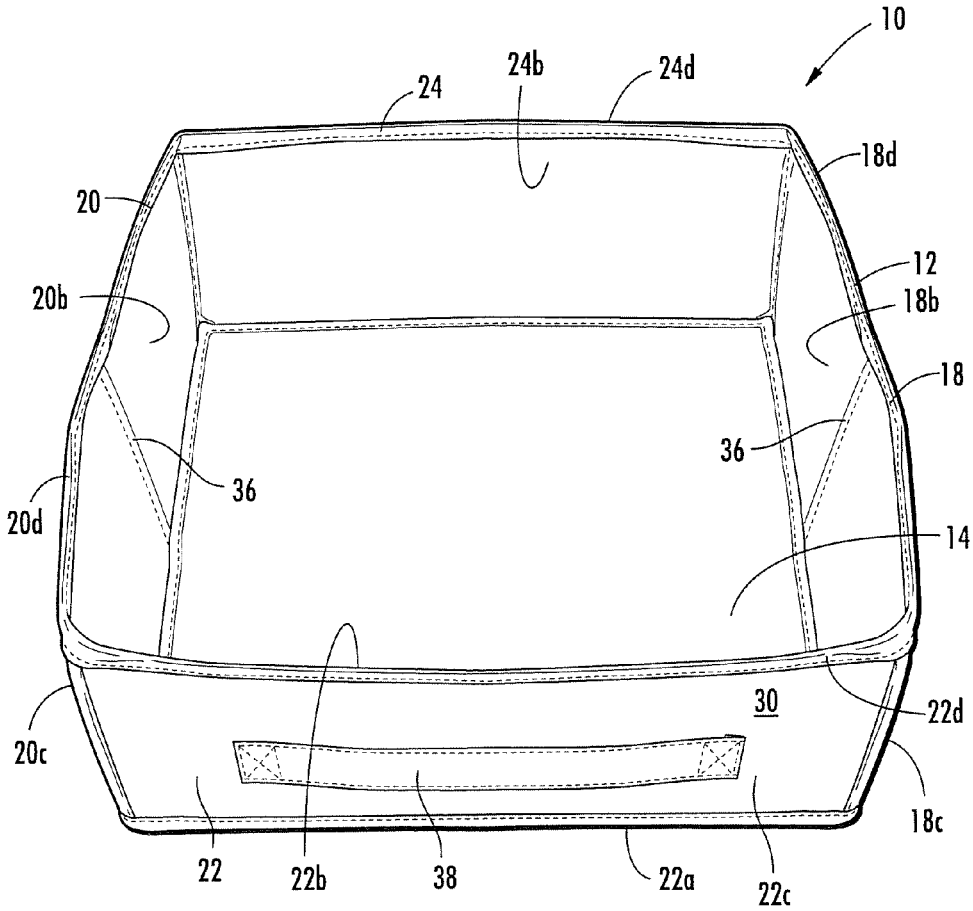
FIG. 3 is a perspective view of the collapsible storage container of FIG. 1, with the fabric receiving member of FIG. 2 placed therein.

As illustrated in FIGS. 1 and 3, the side walls 18, 20 and end walls 22, 24 each have inner and outer faces. For example, side wall 18 has inner face 18*b* and outer face 18*c*; side wall 20 has inner face 20*b* and outer face 20*c*; end wall 22 has inner face 22*b* and outer face 22*c*; and end wall 24 has inner face 24*b* and outer face 24*c*. The inner faces 18*b*, 20*b*, 22*b*, 24*b* of the side walls 18, 20 and end walls 22, 24 are covered with a fabric 28, and the outer faces 18*c*, 20*c*, 22*c*, 24*c* of the side walls 18, 20 and end walls 22, 24 are covered with fabric 30. In some embodiments, fabric 30 is a decorative fabric and fabric 28 is a less decorative liner fabric. However, embodiments of the present invention are not limited to any particular fabric configuration. Any type of fabric with any type of decoration, style, color, etc., can be used for fabric 28 and fabric 30 without limitation.

In some embodiments, the flexible bottom section 26 may be the same decorative fabric 30 that covers the outer faces

18*c*, 20*c*, 22*c*, 24*c* of the side walls 18, 20 and end walls 22, 24. However, in other embodiments different fabrics may be utilized for the flexible bottom section 26 and the outer surfaces 18*c*, 20*c*, 22*c*, 24*c* of the side walls 18, 20 and end walls 22, 24. In other embodiments, different decorative fabrics may be used on the outer surfaces of one or more of the side walls 18, 20 and end walls 22, 24.

Figure 4:
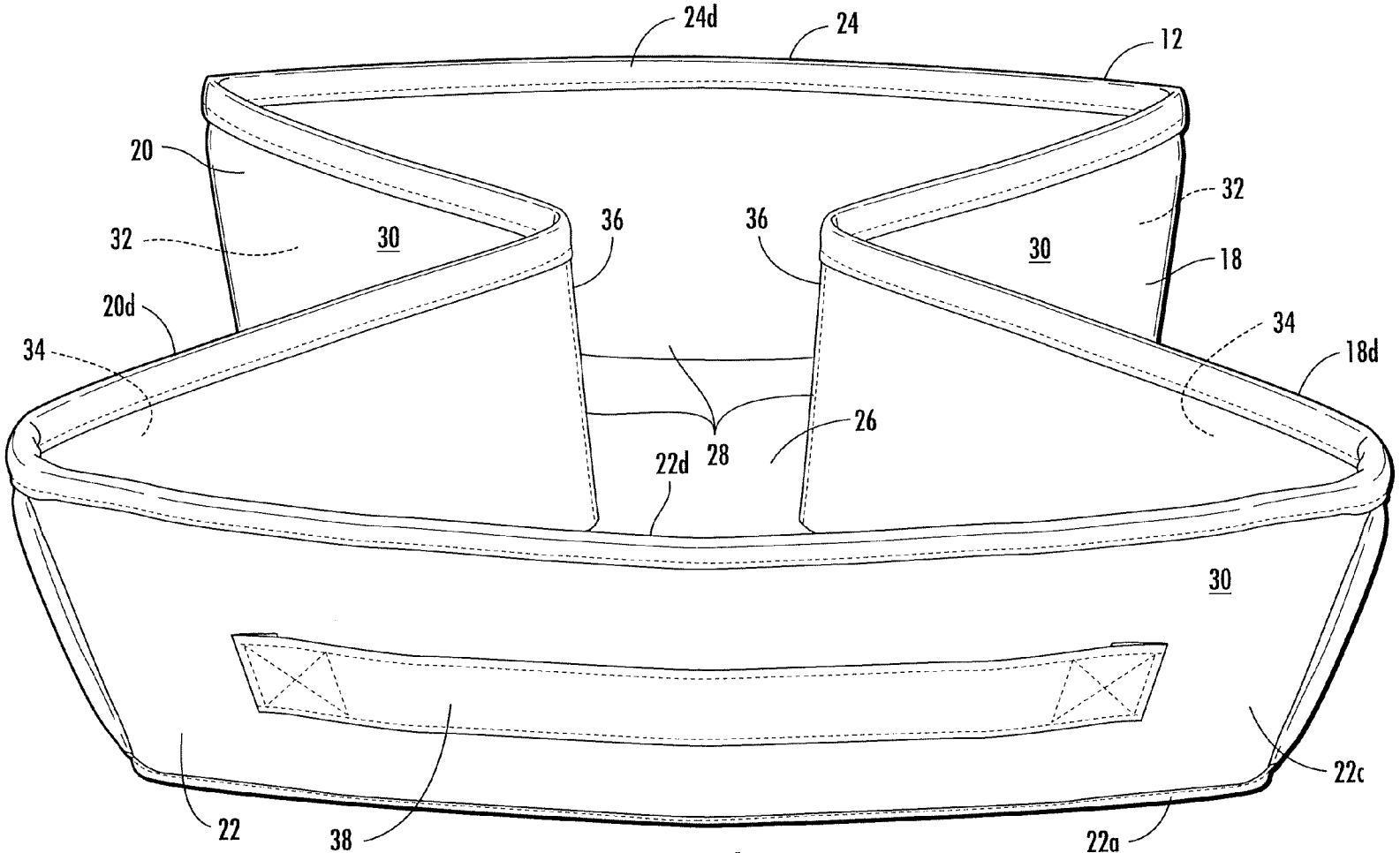
FIG. 4 is a perspective view of the collapsible storage container of FIG. 1 with the side walls being folded such that the container is moved to a collapsed configuration.
Figure 5:
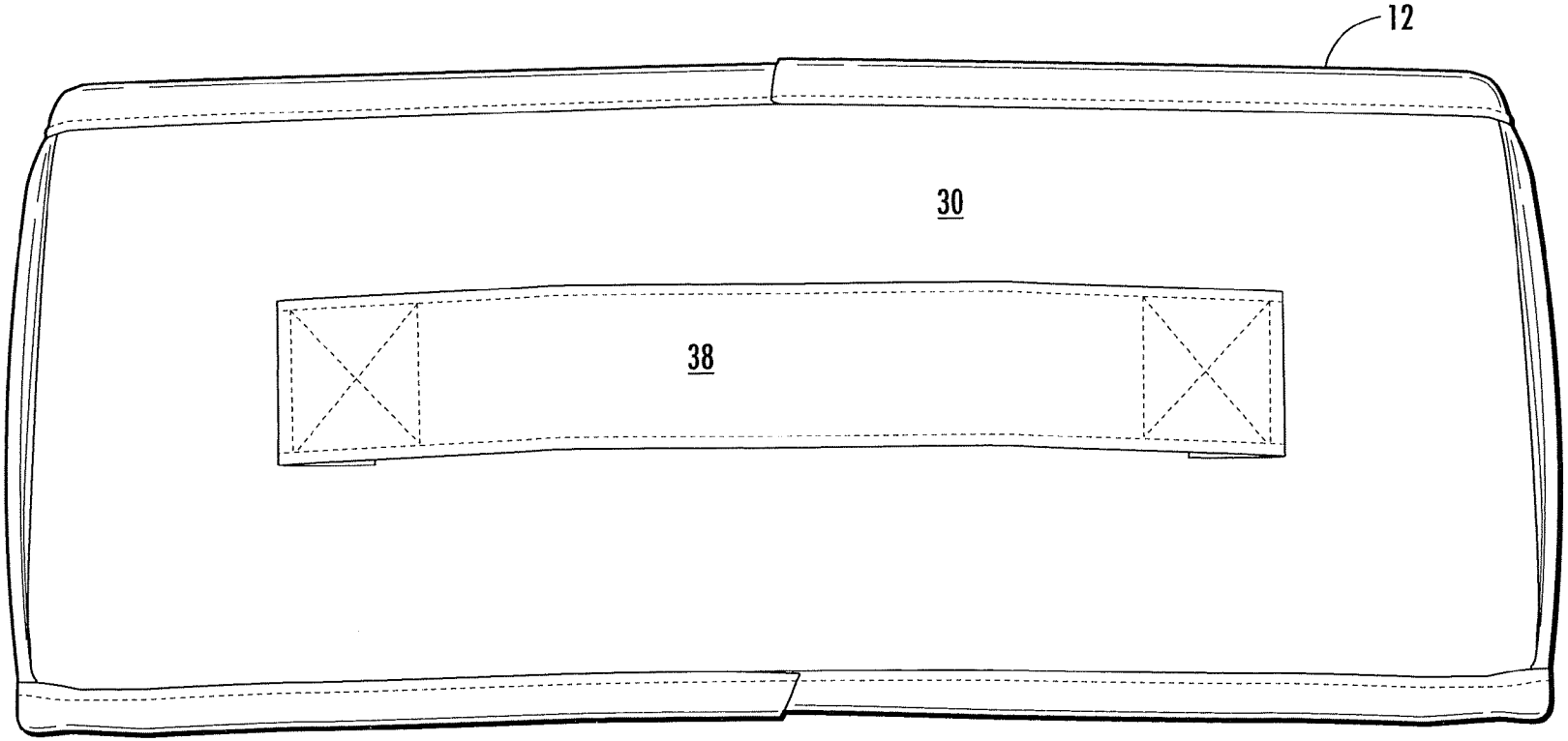
FIG. 5 is a plan view of the collapsible storage container of FIG. 4 in a collapsed configuration.

In the illustrated embodiment, the decorative fabric 30 and liner fabric 28 are sewn together adjacent upper edge portions 18*d*, 20*d*, 22*d*, 24*d* of the side walls 18, 20 and end walls 22, 24, and adjacent lower edge portions 18*a*, 20*a*, 22*a*, 24*a* of the side walls 18, 20 and end walls 22, 24 to form sleeves that receive the side walls 18, 20 and end walls 22, 24 therein. In the illustrated embodiment, the side walls 18, 20 are each formed from two separate panels 32, 34 that are separated by a seam 36 attaching the decorative fabric 30 and liner fabric 28. The seam 36 acts as a hinge that permit the panels 32, 34 to fold in face-to-face contacting relationship as illustrated in FIG. 4.

Embodiments of the present invention are not limited to the illustrated configuration of side walls 18, 20 and the decorative fabric 30 and liner fabric 28. In other embodiments, instead of separate panels 32, 34, side walls 18, 20 may each be a single panel that is scored to facilitate folding. In yet other embodiments, the separate panels 32, 34 of side walls 18, 20 may be hingedly connected together to facilitate folding thereof. In some embodiments, no fabric may be utilized to cover panels 32, 34.

In the illustrated embodiment, the fabric receiving member 14 is covered with the same liner fabric 28 as the inner faces 18*b*, 20*b*, 22*b*, 24*b* of the side walls 18, 20 and end walls 22, 24. The fabric 28 on each side of the fabric receiving member 14 is sewn together along the peripheral edge 14*a* of the fabric receiving member 14. However, embodiments of the present invention are not limited to the fabric receiving member 14 being covered with the same material as the inner faces 18*b*, 20*b*, 22*b*, 24*b* of the side walls 18, 20 and end walls 22, 24. In some embodiments, other material may utilized. In some embodiments, the fabric receiving member 14 may remain uncovered. For example, the fabric receiving member 14 may be a non-covered material such as polymeric material, paperboard, cardboard, or any other suitable material.

In the illustrated embodiment, the storage container 10 includes a pair of handles 38, each secured to a respective end wall 22, 24. The handles 38 may be strips of the same decorative fabric that cover the outer surfaces 18*c*, 20*c*, 22*c*, 24*c* of the side walls 18, 20 and end walls 22, 24. The handles 38 are sewn to the decorative fabric 30 in the illustrated embodiment. In other embodiments, a fabric different from the fabric covering outer surfaces 18*c*, 20*c*, 22*c*, 24*c* may be utilized for the handles 38. Handles, however, are not required, and some embodiments of the present invention may not include handles.

Embodiments of the present invention do not require the use of a decorative fabric 30 on the outer surfaces 18*c*, 20*c*, 22*c*, 24*c* of the side walls 18, 20 and end walls 22, 24, nor do embodiments require the use of a liner fabric 28 on the inner surfaces 18*b*, 20*b*, 22*b*, 24*b* of the side walls 18, 20 and end walls 22, 24. In some embodiments, the side walls 18, 20 and end walls 22, 24 may remain uncovered. For example, the side walls 18, 20 and end walls 22, 24 may be a non-covered material such as polymeric material, paperboard, cardboard, or any other suitable material.

Referring now to FIG. 7, a fabric 16, prior to being stored within the container 10, is wrapped around the fabric receiving member 14. Fabric receiving member 14 facilitates folding of fabrics, particularly bedding fabrics such as fitted sheets, that may be particularly difficult to fold. Once wrapped around the fabric receiving member 14, the fabric 16 can be stored within the container 12 (FIG. 8).

In some embodiments, instructions regarding how to wrap and/or fold fabrics prior to being stored within the container 10 are provided on the fabric receiving member 14. Fabric receiving member 14 can also serve the function of an instruction card. Exemplary folding instructions for various fabrics are provided below.

Pillowcase:

1. Center included instruction card (i.e., fabric receiving member 14) along sewn end of pillowcase;
2. Fold bottom edge up over card, then fold top edge down;
3. Leaving card in place, fold once toward hemmed end;
4. Remove card and place on top of pillowcase at left edge;
5. Fold over twice more toward hem, then remove card; and
6. Repeat for second pillowcase.

Fitted Sheet

1. Tuck bottom corners into top corners;
2. Fold in half right to left;
3. Fold under rounded elastic edges to straighten bottom edge;
4. Align included instruction card with bottom right corner of sheet;
5. Holding instruction card against sheet, make a ⅓ fold into the middle;
6. Leaving card in place, fold remaining third down over previous fold;
7. Still leaving card in place, make a ¼ fold into the center;
8. Remove card and place on top of sheet at left edge;
9. Hold instruction card against sheet and make a ¼ fold into the center; and
10. Leaving card in place, fold in half, then remove card.

Flat Sheet

1. Fold sheet in half top to bottom;
2. Fold sheet in half side to side;
3. Align included instruction card with the only unhemmed corner and fold once toward the middle;
4. Leaving card in place, fold bottom edge up;
5. Still leaving card in place, fold towards hemmed edge once;
6. Remove card and place on top, then fold over twice more and remove card;
7. Stack folded pillowcases and fitted sheet onto folded portion of flat sheet and fold hemmed edge over; and
8. Place instruction card in bottom of cube and place sheets on top.

To facilitate the width of fabric wrapped around the fabric receiving member 14, in some embodiments, the fabric receiving member 14 is dimensioned such that a peripheral gap of between about 0.25" and about 1.25" exists between the fabric receiving member 14 and the inside of the container 12 when the fabric receiving member 14 is inserted within the container 12 without fabric wrapped therearound. In other words, a length and width of fabric receiving member 14 is less than a corresponding internal length and width of the container 12.

Figure 9A:
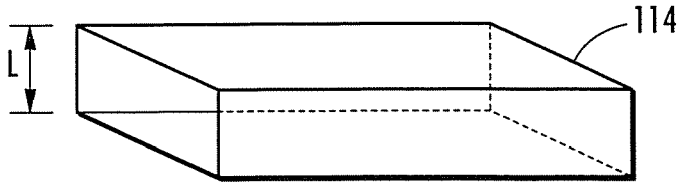
FIGS. 9A-9B and 10A-10B illustrate fabric receiving members or templates, according to other embodiments of the present invention.
Figure 9B:
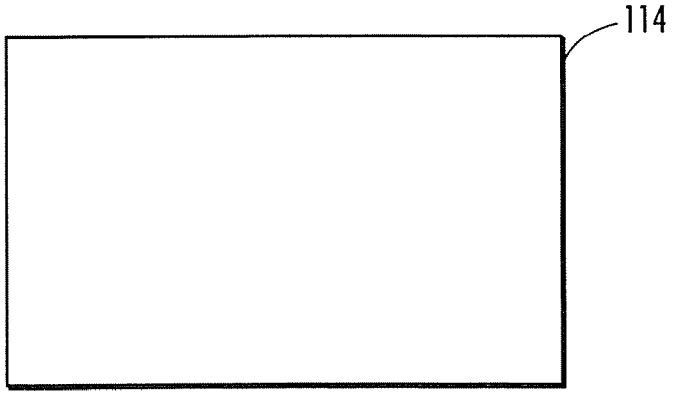

In the illustrated embodiment, fabric receiving member 14 is a planar substrate having a generally rectangular configuration. However, in other embodiments, fabric receiving members can have different shapes and configurations for receiving bedding fabric wrapped therearound. For example, as illustrated in FIGS. 9A-9B, a fabric receiving member 114 is a tube having a generally rectangular cross section, and having an axial length L that is less than a height H of the rectangular container 12 (FIG. 1). Tubes of various cross sectional configurations may be utilized, however. Embodiments of the present invention are not limited to rectangular cross sections.

Figure 10A:
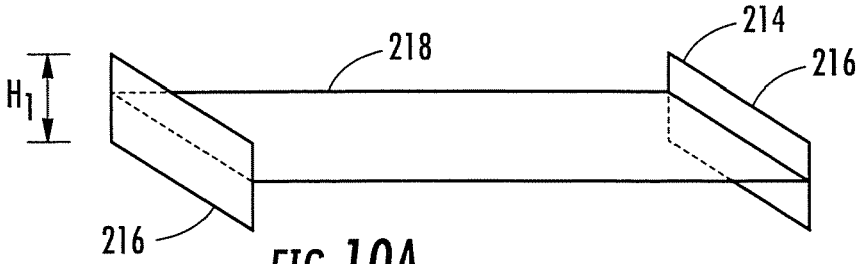
Figure 10B:
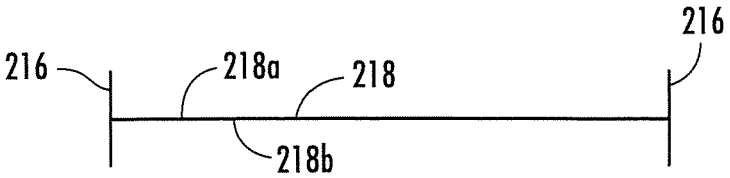

Referring to FIGS. 10A-10B, a fabric receiving member 214 for receiving fabric wrapped therearound and configured to be inserted within container 12, according to other embodiments of the present invention, is illustrated. The illustrated fabric receiving member 214 has an H-type frame that includes a pair of vertically disposed longitudinally spaced end members 216 interconnected in upstanding relationship by a transverse member 218. The transverse member 218 has an upper and lower surface 218*a*, 218*b* and serves the function of a spool configured to receive fabric wrapped therearound. The pair of vertically disposed longitudinally spaced end members 216 each have a height $H_1$ that is less than a height H of the rectangular container 12 (FIG. 1).

Embodiments of the present invention can facilitate easy storage of fabric products, particularly bedding fabrics that may be difficult to fold and store. Collapsible storage apparatus according to the present invention are lightweight and easy to use. Moreover, embodiments of the present invention also can promote the efficient use of storage space. Embodiments of the present invention can be sold with fabric products and can facilitate marketing and sales of various fabric products because of the novel storage apparatus provided.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A collapsible storage apparatus for fabrics, comprising:

a container movable between a collapsed position and a use position, wherein the container is formed from two opposed side walls having opposite top and bottom edge portions, two opposed end walls having opposite top and bottom edge portions, and a flexible bottom section attached to the bottom edge portions of the side and end walls, wherein each of the end walls is sandwiched between an outer fabric layer and an inner fabric layer that are sewn together along the end wall top and bottom edge portions to form a sleeve that receives the end wall therein, wherein each of the side walls is sandwiched between the outer and inner fabric layers that are sewn together along the side wall top and bottom edge portions to form a sleeve that receives the side wall therein, wherein each side wall comprises two separate panels separated by a seam, and wherein each seam acts as a hinge to permit the respective panels to fold in face-to-face contacting relationship, wherein, when the container is in the collapsed position, each side wall is folded such that the container has a flat configuration with the folded side walls sandwiched between the end walls such that the top edge portions of the folded side walls and end walls are in adjacent, aligned relationship with each other; and a fabric receiving member dimensioned to receive fabric wrapped therearound such that the fabric receiving member and fabric wrapped therearound can be removably stored within the container when the container is in the use position.

2. The apparatus of claim 1, wherein the container has a substantially rectangular configuration with substantially rectangular side walls and end walls.

3. The apparatus of claim 1, wherein the fabric receiving member is dimensioned such that a peripheral gap of between about 0.25" and about 1.25" exists between the fabric receiving member and the inside of the container when the fabric receiving member is stored within the container without fabric wrapped therearound.

4. The apparatus of claim 1, wherein the fabric receiving member is substantially rigid.

5. The apparatus of claim 1, wherein the flexible bottom section comprises fabric.

6. The apparatus of claim 1, wherein the fabric receiving member comprises a planar substrate having a generally rectangular configuration.

7. The apparatus of claim 1, wherein the fabric receiving member comprises a tube, wherein the tube has an axial length that is less than a height of the rectangular container.

8. The apparatus of claim 7, wherein the tube has a rectangular cross section.

9. The apparatus of claim 1, wherein the fabric receiving member comprises an H-type frame comprised of a pair of vertically disposed longitudinally spaced end members interconnected in upstanding relationship by a transverse member, said transverse member having an upper and lower surface.

10. The apparatus of claim 1, further comprising a pair of handles, each of the handles secured to a respective one of the end walls, wherein each handle is formed by a respective strip of fabric, and wherein the strip of fabric and the outer fabric layer are the same material.

11. The apparatus of claim 1, wherein medial edges of the folded side walls are closely spaced when the container is in the collapsed position.

12. The apparatus of claim 5, wherein the fabric of the flexible bottom section and the outer fabric layer are the same material.

* * * * *